US007900673B2

(12) United States Patent
Mainous et al.

(10) Patent No.: US 7,900,673 B2
(45) Date of Patent: Mar. 8, 2011

(54) TISSUE MANUFACTURING/HANDLING DEVICE

(75) Inventors: David L. Mainous, Hamilton, OH (US); Chris Jamison, West Chester, OH (US); Clark Brown, South Lebanon, OH (US); David Swedes, Loveland, OH (US)

(73) Assignee: Valco Cincinnati, Inc., Cincinnati, OH (US)

( * ) Notice: Subject to any disclaimer, the term of this patent is extended or adjusted under 35 U.S.C. 154(b) by 1750 days.

(21) Appl. No.: 11/072,784

(22) Filed: Mar. 4, 2005

(65) Prior Publication Data

US 2006/0076452 A1 Apr. 13, 2006

Related U.S. Application Data

(60) Provisional application No. 60/613,841, filed on Sep. 28, 2004.

(51) Int. Cl.
*B32B 37/20* (2006.01)
*B65H 35/10* (2006.01)

(52) U.S. Cl. ..... 156/356; 156/357; 156/367; 156/368; 156/578

(58) Field of Classification Search ..... 156/356, 156/357, 367, 368, 578; 242/532.3; 118/680, 118/681, 683, 692
See application file for complete search history.

(56) References Cited

U.S. PATENT DOCUMENTS

| | | | | |
|---|---|---|---|---|
| 3,951,890 | A | | 4/1976 | Reilly et al. |
| 4,432,301 | A | | 2/1984 | Diesel |
| 4,659,029 | A | | 4/1987 | Rodriguez |
| 4,775,110 | A | | 10/1988 | Welp et al. |
| 5,092,533 | A | | 3/1992 | Gangemi |
| 5,213,649 | A | | 5/1993 | Sepavich et al. |
| 5,222,679 | A | | 6/1993 | Dropczynski et al. |
| 5,314,132 | A | | 5/1994 | Ando et al. |
| 5,453,141 | A | | 9/1995 | Rodriguez |
| 5,723,222 | A | | 3/1998 | Sato et al. |
| 5,810,279 | A | | 9/1998 | Rodriguez et al. |
| 5,845,866 | A | | 12/1998 | Kaipf |
| 6,045,085 | A | * | 4/2000 | Andersson et al. ..... 242/532.3 |
| 6,073,824 | A | | 6/2000 | Gray et al. |
| 6,086,010 | A | | 7/2000 | Kayser |
| 6,253,818 | B1 | | 7/2001 | Preinknoll |
| 6,467,719 | B1 | | 10/2002 | Rodriguez |
| 6,705,560 | B1 | | 3/2004 | Rågård et al. |
| 6,805,317 | B1 | * | 10/2004 | Andersson et al. ..... 242/532.3 |
| 2003/0160128 | A1 | * | 8/2003 | Jamison et al. ..... 242/532.3 |

FOREIGN PATENT DOCUMENTS

| | | |
|---|---|---|
| CA | 2 429 689 | 6/2002 |
| CA | 2 429 693 | 6/2002 |
| EP | 0931744 A2 | 7/1999 |
| WO | WO 02/44064 A1 | 6/2002 |

* cited by examiner

*Primary Examiner* — George R Koch, III
(74) *Attorney, Agent, or Firm* — Dinsmore & Shohl LLP

(57) ABSTRACT

A tissue manufacturing/handling device is provided. The device comprises a reel turn-up section including a tissue reeling station and an adhesive application system. The tissue reeling station is configured to provide a tissue spool in the path of an advancing tissue web. The adhesive application system is configured to apply a turn-up adhesive to the advancing tissue web or the tissue spool and comprises an adhesive spray rack. The spray rack comprises at least one adhesive applicator nozzle coupled to an adhesive manifold via an adhesive valve assembly. The spray rack comprises a rotation mechanism configured to permit reciprocal rotation of the spray rack about an axis substantially parallel to the spray rack axis between a spray position and at least one maintenance position. Additional embodiments are disclosed and claimed.

20 Claims, 5 Drawing Sheets

TISSUE MANUFACTURING/HANDLING DEVICE

CROSS-REFERENCE TO RELATED APPLICATIONS

This application claims the benefit of U.S. Provisional Application Ser. No. 60/613,841, filed Sep. 28, 2004.

BACKGROUND OF THE INVENTION

The present invention relates to tissue manufacturing and handling devices and, more particularly, to tissue manufacturing and handling lines where an adhesive spray is utilized to affect reel-to-reel transfer of an advancing tissue web.

BRIEF SUMMARY OF THE INVENTION

The current state of the art in the tissue making industry embodies a variety of schemes for effecting transfer of an advancing tissue web from a tissue real at or near capacity to a new tissue reel. A number of these schemes involve the spray application of an adhesive to either the advancing web, the new reel, or both, to facilitate turn-up of the advancing web onto a new tissue reel. The present invention introduces improvements in the methodology and hardware of such schemes.

A detailed description of the variety of tissue manufacturing/handling devices and the various tissue transfer schemes employed therein is not presented herein because such a description would be beyond the scope of the present invention and may be readily gleaned from a number of sources, including a number of U.S. patents and patent application publications. For example, and not by way of limitation, a number of relevant documents are classified in the subclasses indented under class 242 (WINDING, TENSIONING, OR GUIDING), subclass 520 (CONVOLUTE WINDING OF MATERIAL) in the U.S. Patent and Trademark Office patent classification system. United States Patent Application Publication No. US 2003/0160128, the disclosure of which is incorporated herein by reference, is an example of one patent application publication classified as such.

In accordance with one embodiment of the present invention, a tissue manufacturing/handling device is provided. The device comprises a reel turn-up section including a tissue reeling station and an adhesive application system. The tissue reeling station is configured to provide a tissue spool in the path of an advancing tissue web. The adhesive application system is configured to apply a turn-up adhesive to the advancing tissue web or the tissue spool and comprises an adhesive spray rack. The spray rack comprises at least one adhesive applicator nozzle coupled to an adhesive manifold via an adhesive valve assembly. The spray rack comprises a rotation mechanism configured to permit reciprocal rotation of the spray rack about an axis substantially parallel to the spray rack axis between a spray position and at least one maintenance position.

In accordance with another embodiment of the present invention, a tissue manufacturing/handling device is provided. The device comprises a reel turn-up section including a tissue reeling station and an adhesive application system. The adhesive application system comprises (i) an adhesive pump configured to pressurize turn-up adhesive within an adhesive manifold, (ii) a pressure transducer configured to provide an indication of a degree of adhesive pressurization in the adhesive manifold or an adhesive conduit in communication with the adhesive manifold, and (iii) a pressure controller in communication with the pressure transducer. The pressure controller is configured to (i) activate the adhesive pump in response to a signal indicating that initiation of the turn-up sequence is approaching, (ii) operate the adhesive pump as a function of a signal received from the pressure transducer, and (iii) deactivate the adhesive pump following completion of the turn-up sequence and prior to initiation of a subsequent turn-up sequence.

In accordance with yet another embodiment of the present invention, a tissue manufacturing/handling device is provided wherein the adhesive valve assembly is coupled to the adhesive manifold via a direct mount fitting extending from the manifold to the valve assembly. The direct mount fitting defines a fitting input coupled to the adhesive manifold and a fitting output coupled to the valve assembly. The direct mount fitting comprises an angled fitting defining at least two rotational degrees of freedom of movement, each of the degrees of freedom of movement being defined about non-parallel axes of rotation.

Accordingly, it is an object of the present invention to provide improvements in tissue manufacturing and handling lines where an adhesive spray is utilized to affect reel-to-reel transfer of an advancing tissue web. Other objects of the present invention will be apparent in light of the description of the invention embodied herein.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1:
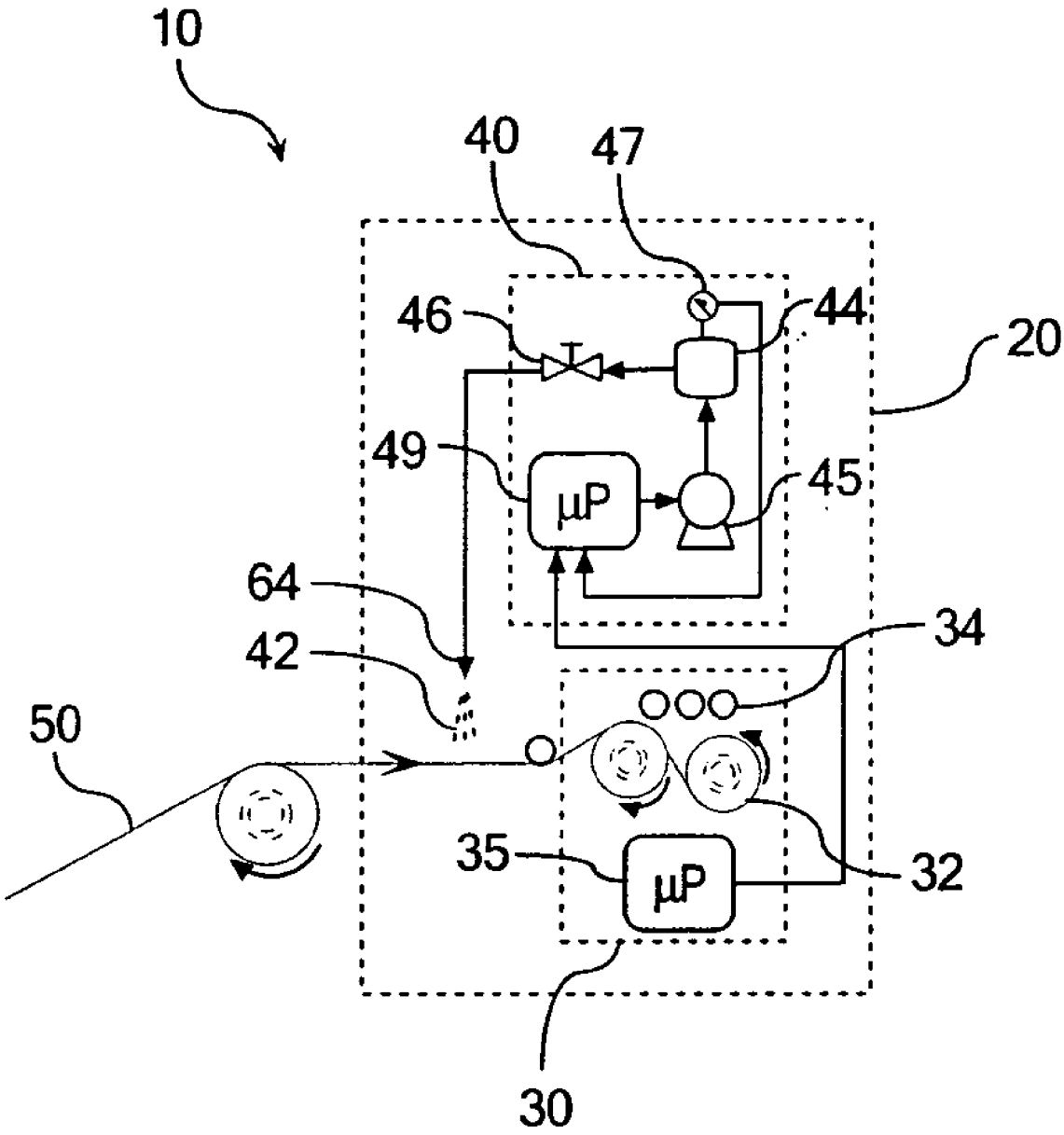
FIG. 1 is a schematic illustration of a tissue manufacturing/handling device comprising a reel turn-up section including a tissue reeling station and an adhesive application system according to one embodiment of the present invention

Referring initially to FIG. 1, a tissue manufacturing/handling device 10 according to one embodiment of the present invention comprises a reel turn-up section 20 including a tissue reeling station 30 and an adhesive application system 40. The tissue reeling station 30 is configured to provide a tissue spool 32 in the path of an advancing tissue web 50. The advancing tissue web 50 defines a lengthwise dimension extending along the path of the advancing web 50 and a widthwise dimension substantially perpendicular to the lengthwise dimension and originates from a tissue manufacturing process that can include a variety of in line tissue manufacturing and handling devices, the details of which are beyond the scope of the present invention.

Figure 2:
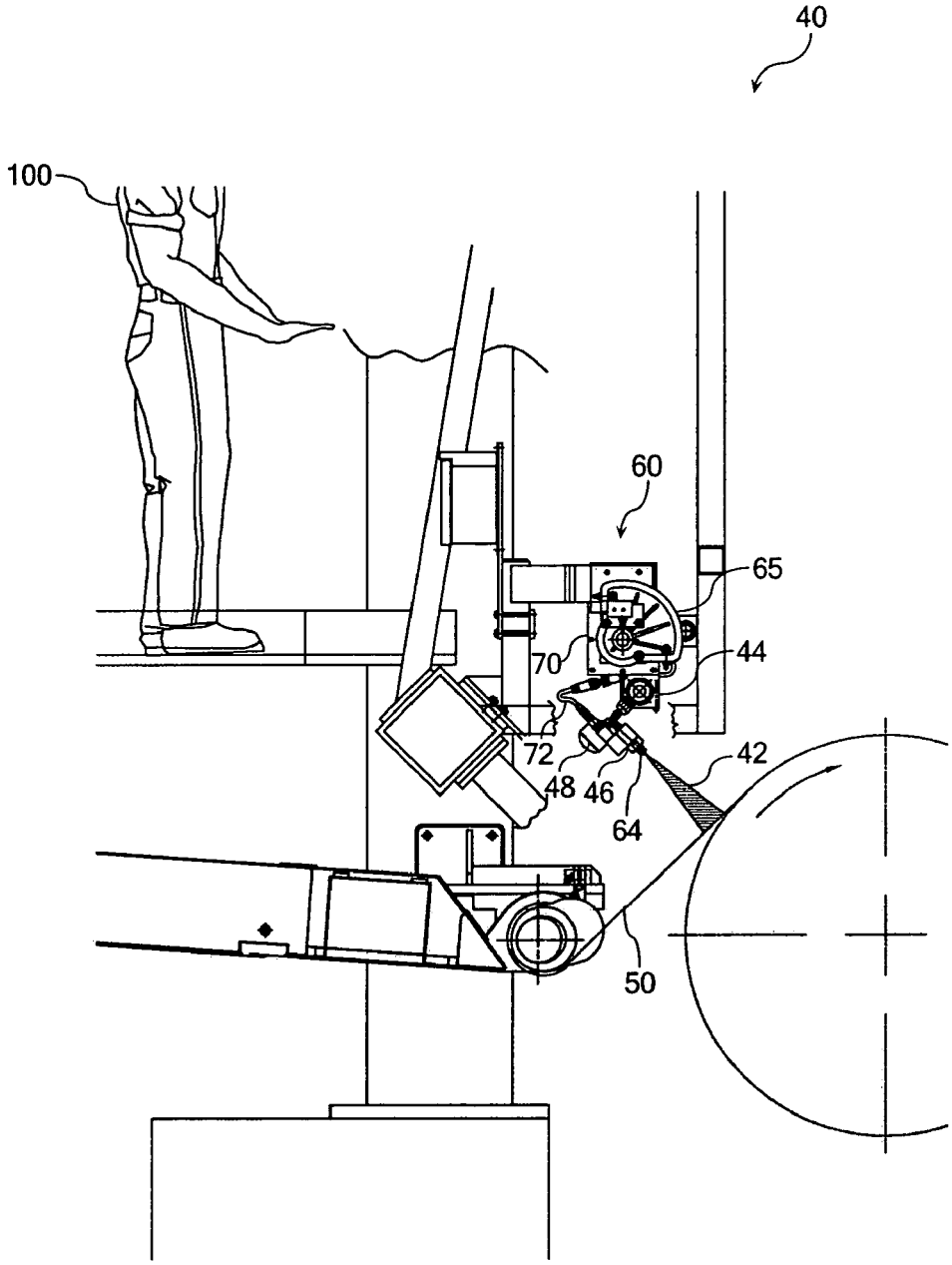
FIG. 2 is an illustration of a tissue manufacturing/handling device according to one embodiment of the present invention where a rotatable spray rack is positioned in the spray position.
Figure 3:
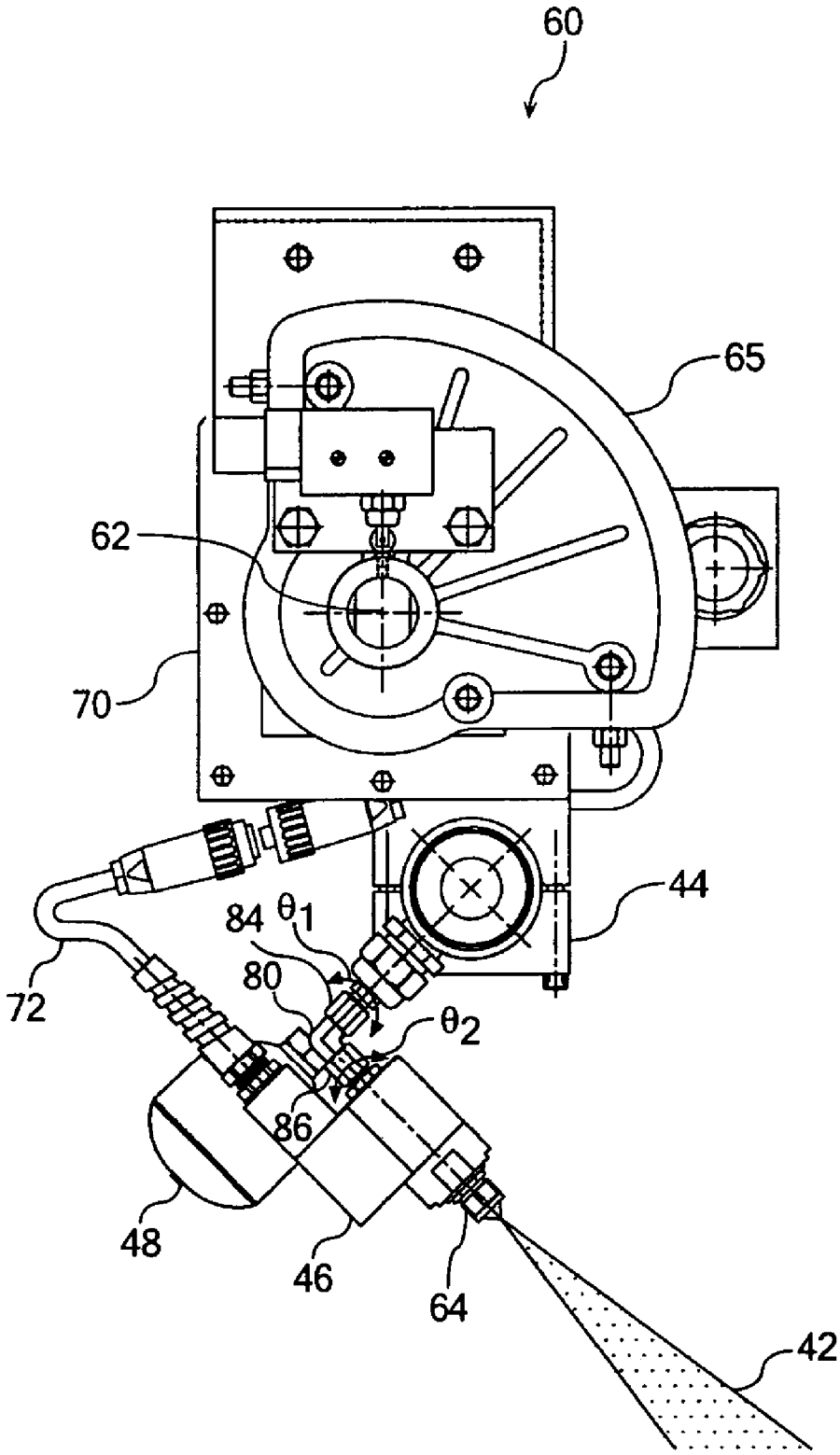
FIG. 3 is a magnified view of a portion of the device illustrated in FIG. 2.

The adhesive application system 40 is configured to apply a turn-up adhesive 42 to the advancing tissue web 50 or to a new tissue spool 34. As can be appreciated from the teachings noted above, the presence of the turn-up adhesive on the web 50 or new spool 34 facilitates turn-up of the web onto the new tissue spool 34. Referring additionally to FIGS. 2 and 3, the adhesive application system 40 comprises an adhesive spray rack 60 oriented along a spray rack axis 62 extending across a widthwise dimension of the advancing tissue web 50. The spray rack 60 comprises a plurality of adhesive applicator nozzles 64 coupled to an adhesive manifold 44 via an adhesive valve assembly 46. Typically, a plurality of nozzles 64 will be arranged along the spray rack 60 but it is also noted that a single nozzle that is movable along the width of the advancing web 50 may be utilized. One or more adhesive accumulators 48 are also placed in communication with the adhesive manifold 44 to help stabilize pressure within the adhesive application system 40.

The spray rack 60 comprises a rotation mechanism 65 configured to permit reciprocal rotation of the spray rack 60 about an axis substantially parallel to the spray rack axis 62. Of course, for the purposes of defining and describing the present invention, it is noted that the axis of rotation and the spray rack axis 62 may be co-axial. In any event, the rotation mechanism 65 is configured to permit reciprocal rotation of the spray rack 60 between the spray position illustrated in FIGS. 2 and 3 and at least one maintenance position, such as those illustrated in FIGS. 4 and 5. It is contemplated that it may be advantageous to ensure that the rotation mechanism 65 is configured to index between the spray position and the nozzle maintenance positions on a selective automated basis.

Figure 4:
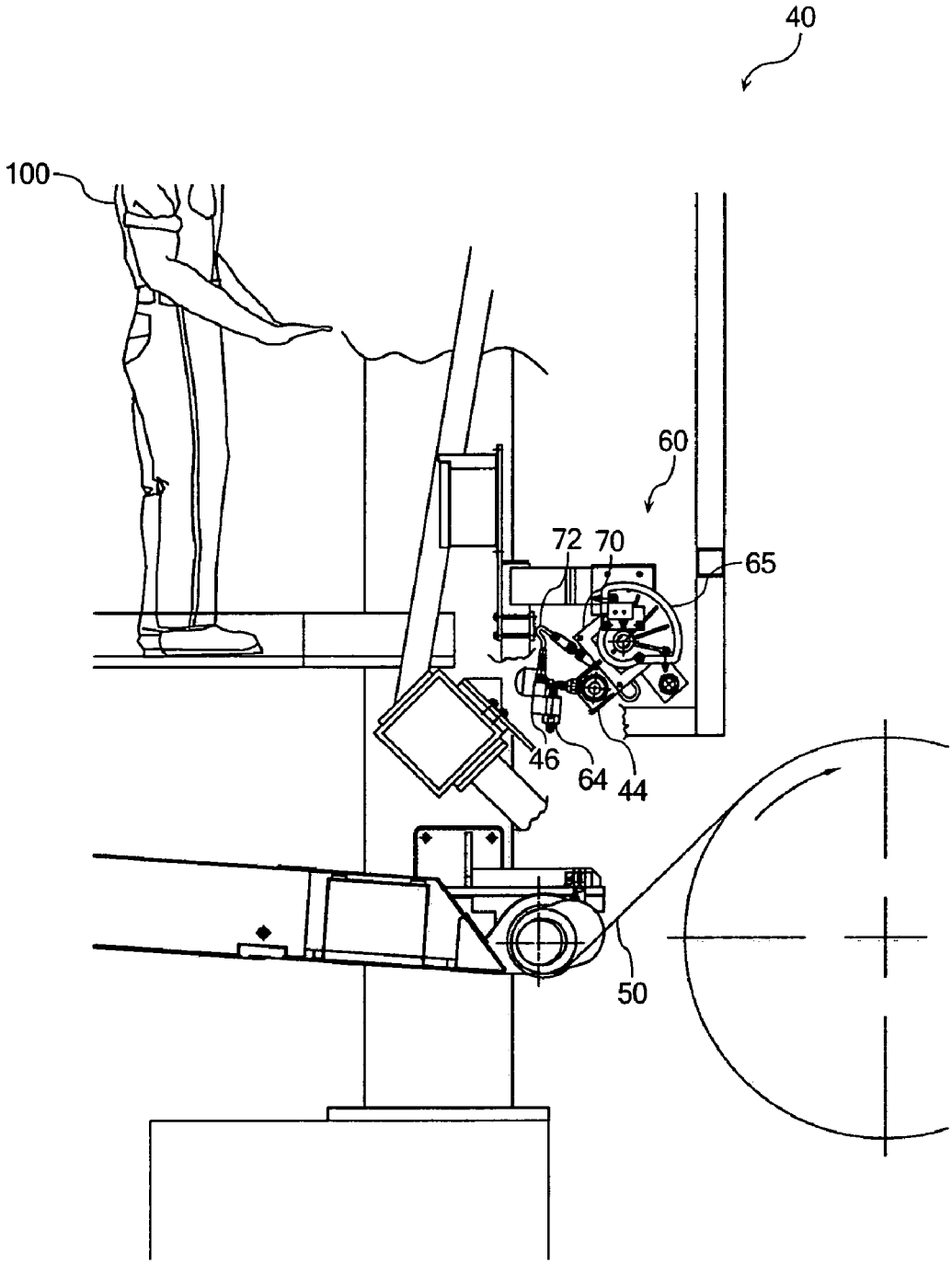
FIG. 4 is an illustration of a tissue manufacturing/handling device according to one embodiment of the present invention where the rotatable spray rack is positioned in the junction box maintenance position.

The maintenance position illustrated in FIG. 4 is referred to herein as the junction box maintenance position because it allows a technician 100 to access and service the electrical junction box 70 and associated electrical connectors 72 serving the adhesive valve assembly 46. By way of illustration and not limitation, it is noted that optimal access is likely to be achieved if the junction box maintenance position is characterized by rotation of the spray rack 60 through an arc of between about 30 degrees and about 60 degrees from the spray position.

Figure 5:
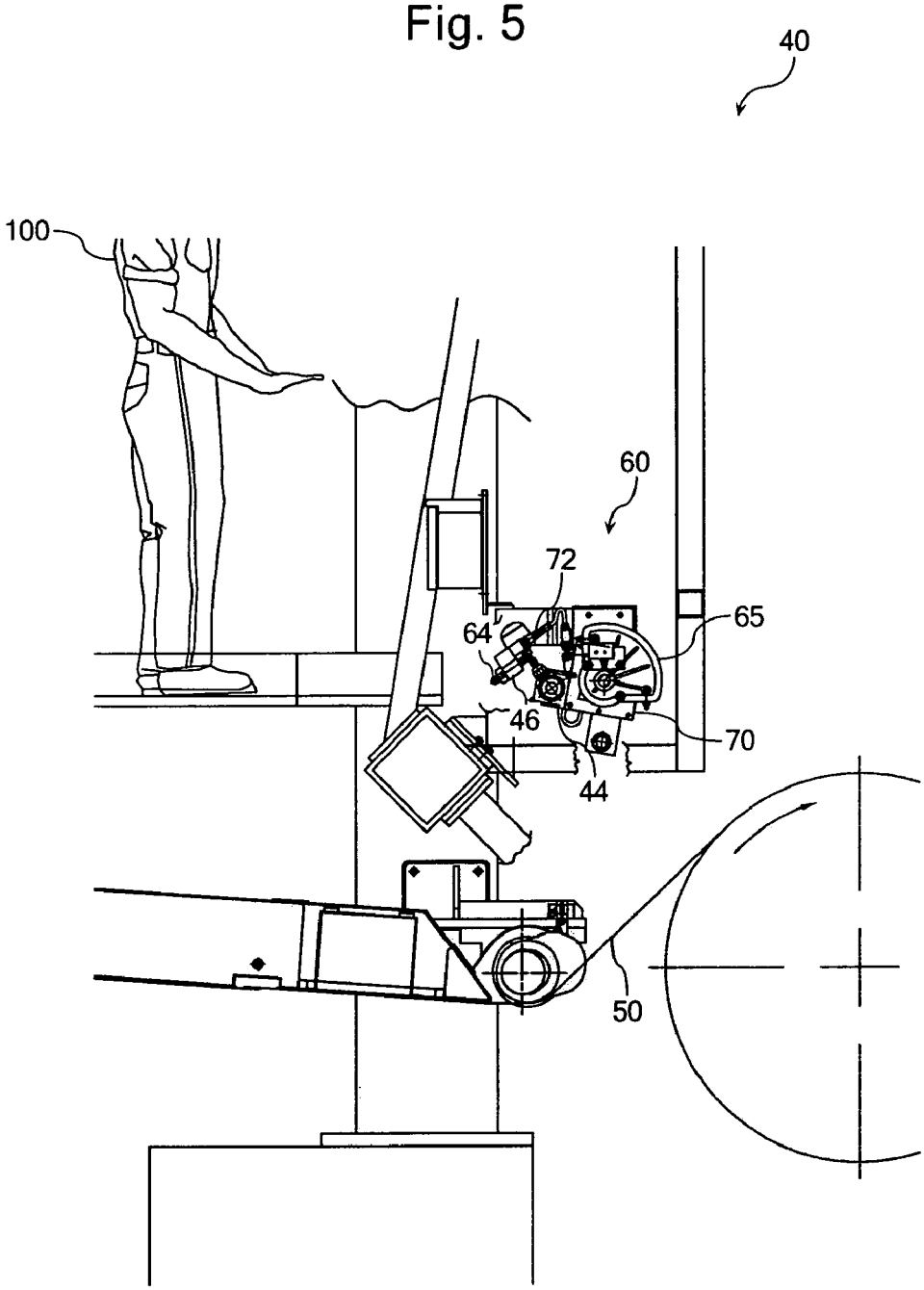
FIG. 5 is an illustration of a tissue manufacturing/handling device according to one embodiment of the present invention where the rotatable spray rack is positioned in the nozzle maintenance position.

Similarly, the maintenance position illustrated in FIG. 5 is referred to herein as the nozzle maintenance position because it allows the technician 100 to access and service the adhesive applicator nozzles 64. By way of illustration and not limitation, it is noted that optimal access is likely to be achieved if the nozzle maintenance position is characterized by rotation of the spray rack 60 through an arc of at least about 75 degrees, or more than 90 degrees, from the spray position.

The adhesive application system 40 can be configured to permit the spray rack 60 to rotate without interrupting the advancement of the tissue web 50. In this manner, the technician 100 can initiate rotation of the spray rack from the spray position of FIGS. 2 and 3 to either or both of the maintenance positions of FIGS. 4 and 5 without disrupting tissue winding operations.

For example, the tissue reeling station 30 may be one where successive tissue spools 32, 34 are provided in the path of the advancing tissue web 50 upon initiation of successive turn-up sequences in the tissue manufacturing/handling device 10. In this case, the rotation mechanism 65 can be configured to permit reciprocal rotation of the spray rack 60 from the spray position to a maintenance position and back in an amount of time that is substantially less than the amount of time between the successive turn-up sequences. Preferably, the duration of the reciprocal rotation time of the spray rack is short enough to allow for spray rack maintenance between the successive turn-up sequences. In this manner, the technician 100 can be assured to have sufficient time to perform maintenance operations and return the spray rack 60 to the spray position prior to initiation of the next turn-up sequence.

Referring to FIG. 1, the reel turn-up section 20 of the present invention also provides for closed loop pressure control of the adhesive application system 40. Specifically, the adhesive applicator nozzle 64 is coupled to a supply of turn-up adhesive via the adhesive manifold 44 and the adhesive valve assembly 46. An adhesive pump 45 is configured to pressurize turn-up adhesive within the adhesive manifold 44 while a pressure transducer 47 provides an adhesive pressure signal. The adhesive pressure signal may correspond to the degree of adhesive pressurization in the adhesive manifold 44 or any other adhesive conduit in communication with the adhesive manifold 44. A pressure controller 49 is placed in communication with the pressure transducer 47 and a reeling station controller 35 and is configured to facilitate closed loop pressure control of the adhesive application system 40.

Specifically, the pressure controller 49 can be configured to activate the adhesive pump 45 in response to a signal indicating that initiation of the turn-up sequence is approaching. For example, and not by way of limitation, the pressure controller 49 can be configured to activate the adhesive pump 45 about 30 seconds to about 240 seconds prior to initiation of the turn-up sequence. Of course, the most suitable duration in this regard will depend upon a number of factors including, pump capacity, manifold volume, operating pressure, etc., and should be selected to ensure that the adhesive application system 40 has ample time to pressurize before adhesive is released from the system.

The pressure controller 49 can also be configured to operate the adhesive pump 45 as a function of a signal received from the pressure transducer 47. For example, and not by way of limitation, the pressure controller 49 can be configured to deactivate the adhesive pump 45 upon receipt of a maximum pressure signal from the pressure transducer 47. Additionally, the pressure controller 49 can be configured to operate the adhesive pump to maintain operating pressure within preferred range, e.g., between about 2000 psi and about 3000 psi, or at or above a given value, e.g., about 1500 psi. It is contemplated that operation at or above about 1500 psi can provide significant assurances against adhesive drippage and clogging at the nozzle 64, particularly where the adhesive is heated to above about 150° F. and the spray duration is limited to below about 500 msec.

The pressure controller 49 can also be configured to deactivate the adhesive pump 45 following completion of the turn-up sequence and prior to initiation of a subsequent turn-up sequence. For example, and not by way of limitation, the pressure controller 49 can be configured such that the deactivation of the adhesive pump 45 following completion of the turn-up sequence is conditioned upon receipt of a signal from, for example, the reeling station controller 35 or other suitable hardware, indicating successful completion of the turn-up sequence. The pressure controller 49 can also be configured to deactivate the adhesive pump 45 upon expiration of a given time period following completion or initiation of the turn-up sequence. As is noted above with respect to activation of the adhesive pump, the most suitable duration in this regard will depend upon a number of factors and should be selected to optimize operating efficiency.

Referring specifically to FIG. 3, the present invention also contemplates an adhesive application system 40 where the adhesive valve assembly 46 is coupled to the adhesive manifold 44 via an angled direct mount fitting 80 extending from the manifold 44 to the valve assembly 46. The direct mount fitting 80 defines a fitting input 84 coupled to the adhesive manifold 44 and a fitting output 86 coupled to the valve assembly 46. The direct mount fitting 80 defines at least two rotational degrees of freedom of movement $\theta_1$, $\theta_2$, each of which is defined about one of the non-parallel axes of rotation defined by the angled direct mount fitting 80. In this manner, the adhesive applicator nozzle 64 can be rotated through each the two degrees of rotational freedom of movement, either cooperatively or independently. The rotation may be facilitated in any suitable manner, utilizing any suitable hardware. For example, and not by way of limitation, the rotation may be provided by complementary threaded portions defined on the fitting 80, the adhesive manifold 44, and the valve assembly 46.

The two rotational degrees of freedom of movement $\theta_1$, $\theta_2$ provided by the direct mount fitting 80 can contribute enhanced functionality to the adhesive application system 40 because they allow for fine tuned adjustment of the orientation of the nozzle spray 42 emanating from each adhesive applicator nozzle 64 while performing the simultaneous role of supporting the valve/nozzle assembly. For example, if it is deemed necessary to adjust the orientation of the nozzle spray cross section on the advancing web 50, the technician 100 can rotate the valve assembly 46 nozzle through $\theta_2$. Alternatively, or additionally, if it is deemed necessary to adjust the relative position at which the nozzle spray contacts the advancing web 50 along the widthwise dimension of the web 50, the technician 100 can rotate the fitting 80 through $\theta_1$.

It is contemplated that a variety of fitting configurations will provide this functionality. For example, and not by way of limitation, an angled nozzle that defines a bend angle of at least about 30° may be sufficient for many applications. Direct mount fittings in the form of 45° and 90° elbows are also contemplated.

For the purposes of describing and defining the present invention, it is noted that reference herein to tissue manufacturing/handling contemplates a variety of systems utilized for the manufacture or handling of tissue products throughout the tissue industry, including but not limited to, tissue webs of a variety of basis weights and configurations including paper towels, napkins, facial tissues, toilet tissues, commercial tissues, etc.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A tissue manufacturing/handling device comprising a reel turn-up section, said reel turn-up section comprising a tissue reeling station and an adhesive application system, wherein:

said tissue reeling station is configured to provide a tissue spool in the path of an advancing tissue web;

said advancing tissue web defines a lengthwise dimension extending along said advancing path and a widthwise dimension substantially perpendicular to said lengthwise dimension;

said adhesive application system is configured to apply a turn-up adhesive to said advancing tissue web or said tissue spool;

said adhesive application system comprises an adhesive spray rack oriented along a spray rack axis extending across a widthwise dimension of said advancing tissue web;

said spray rack comprises at least one adhesive applicator nozzle coupled to an adhesive manifold via an adhesive valve assembly;

said spray rack comprises a rotation mechanism configured to permit reciprocal rotation of said spray rack about an axis substantially parallel to said spray rack axis between a spray position and at least two maintenance positions, said maintenance positions comprising a junction box maintenance position permitting access to an electrical junction box serving said adhesive valve assembly and a nozzle maintenance position permitting access to said adhesive applicator nozzle.

2. A tissue manufacturing/handling device as claimed in claim 1 wherein said rotation mechanism is configured to index selectively between said spray position and said nozzle maintenance positions.

3. A tissue manufacturing/handling device as claimed in claim 1 wherein said junction box maintenance position is characterized by rotation of said spray rack through an arc of between about 30 degrees and about 60 degrees from said spray position.

4. A tissue manufacturing/handling device as claimed in claim 3 wherein said nozzle maintenance position is characterized by rotation of said spray rack through an arc of at least about 75 degrees from said spray position.

5. A tissue manufacturing/handling device comprising a reel turn-up section, said reel turn-up section comprising a tissue reeling station and an adhesive application system, wherein:

said tissue reeling station is configured to provide a tissue spool in the path of an advancing tissue web upon initiation of a turn-up sequence in said tissue manufacturing/handling device;

said adhesive application system is configured to apply a turn-up adhesive to said advancing tissue web, said tissue spool, or both said advancing tissue web and said tissue spool;

said adhesive application system comprises an adhesive spray rack comprising at least one adhesive applicator nozzle coupled to a supply of turn-up adhesive via an adhesive manifold and an adhesive valve assembly;

said adhesive application system further comprises an adhesive pump configured to pressurize turn-up adhesive within said adhesive manifold, a pressure transducer configured to provide an indication of a degree of adhesive pressurization in said adhesive manifold or an adhesive conduit in communication with said adhesive manifold, and a pressure controller in communication with said pressure transducer; and said pressure controller is configured to activate said adhesive pump in response to a signal indicating that initiation of said turn-up sequence is approaching, operate said adhesive pump as a function of a signal received from said pressure transducer, and deactivate said adhesive pump following completion of said turn-up sequence and prior to initiation of a subsequent turn-up sequence.

6. A tissue manufacturing/handling device as claimed in claim 5 wherein said controller is configured such that said deactivation of said adhesive pump following completion of said turn-up sequence is conditioned upon receipt of a signal indicating successful completion of said turn-up sequence.

7. A tissue manufacturing/handling device as claimed in claim 5 wherein said pressure controller is configured to deactivate said adhesive pump upon expiration of a given time period following completion of said turn-up sequence.

8. A tissue manufacturing/handling device as claimed in claim 5 wherein said pressure controller is configured to deactivate said adhesive pump upon expiration of a given time period following initiation of said turn-up sequence.

9. A tissue manufacturing/handling device as claimed in claim 5 wherein said pressure controller is configured to:

activate said adhesive pump about 30 seconds to about 240 seconds prior to initiation of said turn-up sequence;

deactivate said adhesive pump about 5 seconds to about 240 seconds following completion of said turn-up sequence.

10. A tissue manufacturing/handling device as claimed in claim 5 wherein said pressure controller is configured to activate said adhesive pump at least about 30 seconds prior to initiation of a subsequent turn-up sequence.

11. A tissue manufacturing/handling device as claimed in claim 5 wherein said pressure controller is configured to deactivate said adhesive pump upon receipt of a maximum pressure signal from said pressure transducer.

12. A tissue manufacturing/handling device as claimed in claim 5 wherein said adhesive pump is configured to pressurize turn-up adhesive within said adhesive manifold to a pressure of between about 2000 psi and about 3000 psi.

13. A tissue manufacturing/handling device as claimed in claim 5 wherein said adhesive pump is configured to pressurize turn-up adhesive within said adhesive manifold to a pressure exceeding about 1500 psi.

14. A tissue manufacturing/handling device comprising a reel turn-up section, said reel turn-up section comprising a tissue reeling station and an adhesive application system, wherein:

said tissue reeling station is configured to provide a tissue spool in the path of an advancing tissue web;

said adhesive application system is configured to apply a turn-up adhesive to said advancing tissue web or said tissue spool;

said adhesive application system comprises an adhesive spray rack comprising at least one adhesive applicator nozzle coupled to an adhesive manifold via an adhesive valve assembly;

said adhesive valve assembly is coupled to said adhesive manifold via a direct mount fitting extending from said manifold to said valve assembly;

said direct mount fitting defines a fitting input coupled to said adhesive manifold and a fitting output coupled to said valve assembly;

said direct mount fitting comprises an angled fitting defining at least two rotational degrees of freedom of movement, each of said degrees of freedom of movement being defined about non-parallel axes of rotation.

15. A tissue manufacturing/handling device as claimed in claim 14 wherein said direct mount fitting is configured such that said adhesive applicator nozzle can be rotated through said two degrees of rotational freedom of movement.

16. A tissue manufacturing/handling device as claimed in claim 15 wherein said degrees of freedom of rotational movement through which said applicator nozzle can be rotated are provided by complementary threaded portions defined on said fitting, said adhesive manifold, and said valve assembly.

17. A tissue manufacturing/handling device as claimed in claim 14 wherein said direct mount fitting comprises an elbow fitting defining a bend angle of at least about 30°.

18. A tissue manufacturing/handling device as claimed in claim 14 wherein said direct mount fitting comprises a 45° elbow fitting.

19. A tissue manufacturing/handling device as claimed in claim 14 wherein said direct mount fitting comprises a 90° elbow fitting.

20. A tissue manufacturing/handling device as claimed in claim 14 wherein said non-parallel axes of rotation defined by said direct mount fitting are substantially orthogonal.

* * * * *